US007827746B2

(12) United States Patent
Speck

(10) Patent No.: US 7,827,746 B2
(45) **Date of Patent: *Nov. 9, 2010**

(54) HYBRID WINDOW WALL/CURTAIN WALL SYSTEM AND METHOD OF INSTALLATION

(75) Inventor: Juan Antonio Speck, Ontario (CA)

(73) Assignee: Sota Glazing, Inc., Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 12/616,268

(22) Filed: Nov. 11, 2009

(65) Prior Publication Data

US 2010/0050547 A1 Mar. 4, 2010

Related U.S. Application Data

(63) Continuation of application No. 11/171,505, filed on Jul. 1, 2005, now Pat. No. 7,644,549.

(60) Provisional application No. 60/587,515, filed on Jul. 14, 2004.

(30) Foreign Application Priority Data

Jul. 5, 2004 (CA) ..... 2472902

(51) Int. Cl.
*E04H 1/00* (2006.01)
*E04B 5/00* (2006.01)

(52) U.S. Cl. ..... 52/235; 52/236.3; 52/236.6; 52/264

(58) Field of Classification Search ..... 52/234, 52/235, 236.3, 236.6, 236.7, 236.8, 236.9, 52/262, 264, 481.1, 481.2, 573.1, 241, 220.8
See application file for complete search history.

(56) References Cited

U.S. PATENT DOCUMENTS

| | | | | | |
|---|---|---|---|---|---|
| 28,069 | A | | 5/1860 | Fowler | |
| 1,860,782 | A | | 5/1932 | Moore | |
| 1,924,801 | A | * | 8/1933 | Olmsted | 52/236.8 |
| 1,957,026 | A | | 5/1934 | Julius | |
| 2,037,482 | A | | 4/1936 | Boone | |
| 2,043,697 | A | | 6/1936 | Deichmann | |
| 2,914,145 | A | | 11/1959 | Benson | |
| 3,315,426 | A | * | 4/1967 | Rolland | 52/235 |
| 3,702,044 | A | * | 11/1972 | Balinski | 52/30 |
| 3,736,709 | A | | 6/1973 | Koch et al. | |
| 3,742,667 | A | | 7/1973 | Tofani, Jr. | |
| 3,786,605 | A | | 1/1974 | Winfrey | |

(Continued)

*Primary Examiner*—Brian E Glessner
(74) *Attorney, Agent, or Firm*—Oblon, Spivak, McClelland, Maier & Neustadt, L.L.P.

(57) ABSTRACT

There are currently two major types of exterior building envelope finishing systems: window wall systems, and curtain wall systems. Window wall systems use panels which fit between concrete floor slaps, and hence, are prone to leakage and are not aesthetically appealing. Curtain wall systems are installed proud of the concrete slabs, so have better performance, but are expensive to install. The system of the invention has the high performance of a curtain wall system, with the ease of installation of a window wall system. The invention uses rigid panels which cover the face of a building like a curtain wall system, providing a complete gasketed seal without the need for caulking as in the case of window wall systems. The vertical mullions are notched, so that the mullions can be easily anchored to the upper and lower surfaces of the concrete slabs.

23 Claims, 8 Drawing Sheets

U.S. PATENT DOCUMENTS 3,888,055 A * 6/1975 Gallo ..... 52/98
3,936,986 A 2/1976 Steel
3,994,107 A 11/1976 Aughuet
4,055,923 A 11/1977 Biebuyck
4,291,511 A 9/1981 Stoakes
4,343,125 A * 8/1982 Shubow ..... 52/236.8
4,433,524 A 2/1984 Matson
4,449,341 A 5/1984 Taglianetti et al.
4,543,755 A 10/1985 Crandell
4,571,905 A * 2/1986 Kaminaga ..... 52/235
4,583,336 A 4/1986 Shelangoskie et al.
4,633,631 A 1/1987 Crandell
4,662,136 A * 5/1987 Tanikawa et al. ..... 52/235
4,662,145 A * 5/1987 Tanikawa et al. ..... 52/745.1
4,685,263 A 8/1987 Ting
4,716,695 A 1/1988 Alexander et al.
4,738,065 A 4/1988 Crandell
4,782,635 A 11/1988 Hegle
4,998,393 A * 3/1991 Baena ..... 52/236.9
5,063,718 A 11/1991 Nonis
5,067,300 A * 11/1991 Takeda ..... 52/745.1
5,077,947 A 1/1992 Takeda
5,154,029 A 10/1992 Sturgeon
5,158,392 A 10/1992 Takeda
5,212,922 A 5/1993 Werner
5,216,858 A 6/1993 Gilmour
5,239,798 A 8/1993 Saito
5,323,577 A 6/1994 Whitmyer
5,355,645 A 10/1994 Farag
5,381,637 A 1/1995 Farag
5,640,823 A 6/1997 Bergeron et al.
5,669,194 A 9/1997 Colasanto et al.
6,269,600 B1 * 8/2001 Tambakakis ..... 52/235
6,598,361 B2 7/2003 Ting
6,804,920 B2 10/2004 Hogan
7,424,793 B1 9/2008 Shriver
2002/0026766 A1 3/2002 Wooster
2002/0144476 A1 10/2002 Mastelli
2003/0033764 A1 2/2003 Ting
2004/0079038 A1 4/2004 Crooker, Jr.
2006/0123722 A1 6/2006 Stenvall
2006/0185274 A1 8/2006 Merica
2006/0201084 A1 9/2006 Arias

* cited by examiner

HYBRID WINDOW WALL/CURTAIN WALL SYSTEM AND METHOD OF INSTALLATION

CROSS REFERENCE TO THE RELATED APPLICATIONS

This application is a continuation of U.S. Ser. No. 11/171,505 filed Jul. 1, 2005 now U.S. Pat No. 7,644,549, the entire contents of which is incorporated herein by reference. U.S. application Ser. No. 11/171,505 claims priority pursuant to 35 U.S.C §119(e) (1) of Provisional application No. 60/587,515 filed Jul. 14, 2004, the disclosures of which are incorporated herein by reference. This application is based on Canadian Patent Application No. 2,472,902 filed Jul. 5, 2004.

FIELD OF INVENTION

The present invention relates generally to exterior building envelope finishing systems, and more particularly to improvements over curtain wall and window wall systems and the like.

BACKGROUND OF THE INVENTION

The current approach to the construction of large highrise commercial or residential buildings is to first construct a self-supporting structure of a roof, floors and interior bearing members (including posts, beams, bearing walls, columns, and other structural supports), generally out of concrete and/or steel, and then to encase this structure with an exterior shell. The exterior shell provides an insulating, weatherproof, generally air-tight and aesthetic cladding, but essentially no structural strength. The two most common types of exterior shell systems for such buildings are called "window wall" systems and "curtain wall" systems.

In window wall systems, rigid panels of a manageable size and weight are prefabricated to roughly the same height as the spacing between adjacent pairs of concrete floor slabs. These rigid panels are inserted between the concrete floor slabs and are sealed with caulking. These rigid panels can take on a variety of exterior appearances but in general they consist largely of clear glass panels (i.e. windows, which are referred to as "vision glass" in the industry) along with opaque glass or metal infill panels (these opaque glass panels are generally referred to as "spandrel glass"). These rigid panels are framed with horizontal and vertical runs of metal mullions, headers, sills and trim as required. Most window wall systems are constructed of aluminum, although some may be of steel.

A vertical cross-section of a typical window wall system is presented in FIG. 1. In the interest of simplicity, the rigid panels 10 are shown to consist of vision glass only, but combinations of vision glass, spandrel glass, and other finishing materials are also often used. As shown, the rigid panels 10 are framed with top channels 12 and bottom channels 14, and vertical mullions (not shown). The framed, rigid panels 10 are then placed between adjacent pairs of concrete floor slabs 16, 16'. In such an installation, caulking 18, 18' is required at both the top and bottom of the rigid panels 10. In this figure, the faces of the concrete slabs are finished with a metal panel 20, which will typically be painted.

Window wall systems suffer from a number of problems the most significant of which is poor long-term performance. As noted above, regular window wall are sealed with caulking between the rigid panels and the floor slabs—eventually this caulking is going to break down and leakage will occur. The concrete floor slabs keep moving, mainly through winter and summer expansion and contraction cycles. This cycling keeps compressing and decompressing the rigid frames repeatedly, placing a strain on the caulking until it begins to break down. The length of time that it takes for this breakdown to occur depends on the environment and the specifics of the installation, but these components often start opening up after two to five years, thus requiring maintenance. Once the caulking joints start opening up, water will get into the system and damage both the window wall system and the building interior. This deterioration and long-term performance is a severe problem with window wall systems.

Of course, the caulking must also be installed properly in the first place, which is not an easy task. Even pinholes or small cracks may allow water to leak into the building, particularly on the windward side of the building which experiences significant levels of air pressure across the cladding system. If too thin a layer of caulking is applied, or if the surfaces are dirty, oily or wet when the caulking is applied, the seal may fail very quickly or be ineffective right from the beginning.

Conventional curtain wall systems are similar to window wall systems in that they consist of prefabricated rigid panels which form a non-structural exterior cladding for the building. Like window wall systems, these rigid panels consist largely of vision glass with suitable infill panels and framework. They are sized to be of manageable size and weight, but are taller than window wall panels because they equal to the building's story height, rather than the distance between the slabs.

A vertical cross-section of a typical curtain wall system is presented in FIG. 2. In this case, each pre-fabricated rigid panel 30 has been shown to consist of both vision glass 32 and spandrel glass 34, but any combination of vision glass, spandrel glass, sheet metal panels and other finishing materials may also be used. The rigid panels 30 are framed with a bottom channel 36 and vertical mullions (not shown). Each bottom channel engages with the sprandrel glass 34 of the rigid panel 30 mounted below it.

The big difference between curtain wall systems and window wall systems is that the rigid panels 30 of the curtain wall system are hung on the building structure, usually from floor to floor, each module being supported by connectors on the outer area of each concrete floor slab 16, 16'. Rigid curtain wall panels are stacked on each other in parallel rows and adjacent modules are typically connected together.

That is, rather than the rigid panels fitting between the concrete slabs 16, 16' as in the case of window wall systems, they hang from the slabs like curtains, sitting proud of the slab with each panel being sealed to the next with gaskets. In this arrangement, the rigid panels 30 of the curtain wall system are sealed to one another which minimizes the effect of thermal cycling. Hence, this makes a shell which is essentially continuous, and entirely outside the structure of the building.

Conventional curtain wall systems generally do not have the caulking/leakage problem of window wall systems, but they have problems of their own.

To begin with, conventional curtain wall systems have a gap between the vision glass 32/spandrel glass 34 layer and the faces of the concrete slabs 16, 16' which introduces problems with regard to sound transmission, and smoke and fire safing between individual floors. While these issues can be addressed with suitable sealing systems, the larger the gaps are, the more expensive and time consuming they are to fill and they result in a possible failure point for the system.

A related problem is that conventional curtain wall systems have vertical mullions which run continuously from the bottom to the top of the building. These vertical mullions are hollow and boxed-shaped in cross-section, so they essentially act like a duct for the flow of sound and smoke between floors. The interiors of these vertical mullions are not sealed between floors and it would be very expensive and inconvenient to do so.

Also, conventional curtain wall systems require anchors 38 which are embedded directly in the concrete floor slabs to support their rigid panels 30. The supply, layout and installation of these embedded anchors 38 is a costly item, particularly in high labor cost markets. Curtain wall systems are mounted to the top of, or on the face of the concrete floor slabs 16, 16' with one embedded anchor 38 taking care of each vertical mullion. Because each embedded anchor 38 is supporting a great deal of load, including both vertical loads and in/out loads, these embedded anchors are 38 typically cast into the concrete floor slabs 16, 16'. Expansion anchors and other types of concrete fasteners simply are not strong enough to support such loads reliably.

Attempts have been made to address the problems of conventional window wall and curtain wall systems. For example, window wall systems have been provided with an upper channel which runs along the underside of the upper floor slab, the rigid panels 10 being fitted into this channel. This allows for some vertical movement, but the interface of the rigid panel and the horizontal channel still has to be caulked, so it will eventually break down; and this additional interface introduces another point for possible air and water leakage. None of these modified window wall or curtain wall systems have been very successful.

Recently, high-end residential condominium developers, building envelope consultants and architects in Canada and the USA have been asking for a low cost curtain wall system for use in their projects to replace commonly used window wall systems. The uniform response from developers and architects was that they are tired of the poor long-term performance of window wall systems and of the standard "prison look" effect due to restrictions in module width and wide mullion assemblies. Also, the appearance of slab-edge metal cover panels 20 was not aesthetically pleasing.

Because window wall systems are installed between the concrete floor slabs, there is necessarily a horizontal panel 20 at least at every floor slab. As well, because window walls are being designed with very small and weak vertical mullions in the interest of cost reduction, they must be supplied with a larger number of vertical mullions, resulting in more vertical lines. Rather than using four- or five-foot spacings for vertical mullion modules, it is now common to see vertical mullions spaced on three-foot to four-foot centres. The large number of vertical mullions creates a prison-like look with these vertical lines every three feet or so.

Any new window wall or curtain wall system must also take installation cost into consideration. Installers are expensive, especially in markets where the cost of living is high, such as in Manhattan, N.Y. Because of the high labour costs and low productivity levels in such environments, it is also desirable to employ as much factory pre-fabrication as possible. This improves quality, increases productivity of site laborers and reduces damage and loss of materials due to weather conditions, dirt, and storage and handling activities on the construction site.

There is therefore a need for an improved window wall or curtain wall system, provided with consideration for the problems outlined above.

SUMMARY OF THE INVENTION

It is therefore an object of the invention to provide an improved window or curtain wall system and method of installation for such a system, which obviates or mitigates at least one of the disadvantages described above.

One aspect of the invention is broadly defined as a unitized exterior building envelope system for a building comprising: individual framed panels, supported with vertical mullions on their sides, the vertical mullions interconnecting adjacent ones of the individual framed panels; each of the vertical mullions being notched to accommodate the thickness of a concrete floor slab; each of the individual framed panels being attached to the top of a lower floor slab and the underside of an upper floor slab using anchors fastened respectively to the top and underside surface of the concrete floor slabs; and one of the anchors being fixed to the vertical mullion, and the other of the anchors slidably engaging with the vertical mullion.

Another aspect of the invention is broadly defined as a method of installing a wall system comprising the steps of shipping unitized modules to the site fully assembled with vision glass and spandrel glass or other infill materials already shop installed; the integral sleeve anchors being pre-installed into the vertical mullions; the unitized modules being set in place temporarily between two floor slabs; the bottom sleeve anchors sliding inside the vertical mullions being moved/adjusted to correct elevation and being fixed by two fasteners through the side wall of the vertical mullion; the unitized modules then being set plum, and the top sliding anchors being pushed up to the underside of the floor slab and fixed by means of expansion anchors or other fasteners suited to the slab construction.

The invention provides a building envelope system that has the performance of a curtain wall system, but uses rigid panels that are installed between floors. This results in a high performance installation at a lower labour cost, with easier installation of sound and fire sealing.

This summary of the invention does not necessarily describe all features of the invention.

BRIEF DESCRIPTION OF THE DRAWINGS

These and other features of the invention will become more apparent from the following description in which reference is made to the appended drawings wherein.

DESCRIPTION OF THE INVENTION

The invention adapts and modifies a conventional unitized curtain wall system so that it can be installed between concrete floor slabs similar to a conventional window wall system. Modifications were made without negative impact to the superior performance, appearance options and installation capabilities of a conventional unitized curtain wall system.

The main problems of the known systems were solved by notching a conventional unitized curtain wall systems (Sota Glazing's Millennium Series and Thermo 3 Series were used in the development of the invention) around the concrete floor slabs without interrupting the continuous integral gasketed, airseal system of the curtain wall system. A conventional window wall system is completely interrupted between concrete floor slabs and relies on caulked joints between window frames and the concrete floor slabs to create a continuous airseal barrier.

The notching of the curtain wall system around the concrete floor slabs also solves the fire safing and sound attenuation problems usually associated with the use of conventional curtain wall systems. It interrupts the flow through the vertical mullions, and it also brings the rigid panels much closer to the face of the concrete floor slabs, so it is much easier to create a seal between floors.

However, simply notching the structural vertical members of a conventional unitized curtain wall causes a structural system problem. This problem is solved by using a sliding sleeve anchor to support either the top, or the bottom of a given rigid panel. This sliding sleeve anchor will be described in more detail with respect to FIG. 3 hereinafter.

The notching of the system around the floor slabs now allows the architect new design flexibility to incorporate glass, granite, terra cotta or aluminum metal panels in front of the floor slabs. When using a conventional window wall system, the floor slabs are always covered with a formed metal panel, slab edge cover. The invention is capable of supporting and incorporating all the same commonly used infill materials as a conventional curtain wall system, including for example: monolithic and insulated glass units, granite, limestone, stainless steel, aluminum plate and composite panels, metal panel shadow boxes, insulated galvanized and aluminum back pans.

Figure 1:
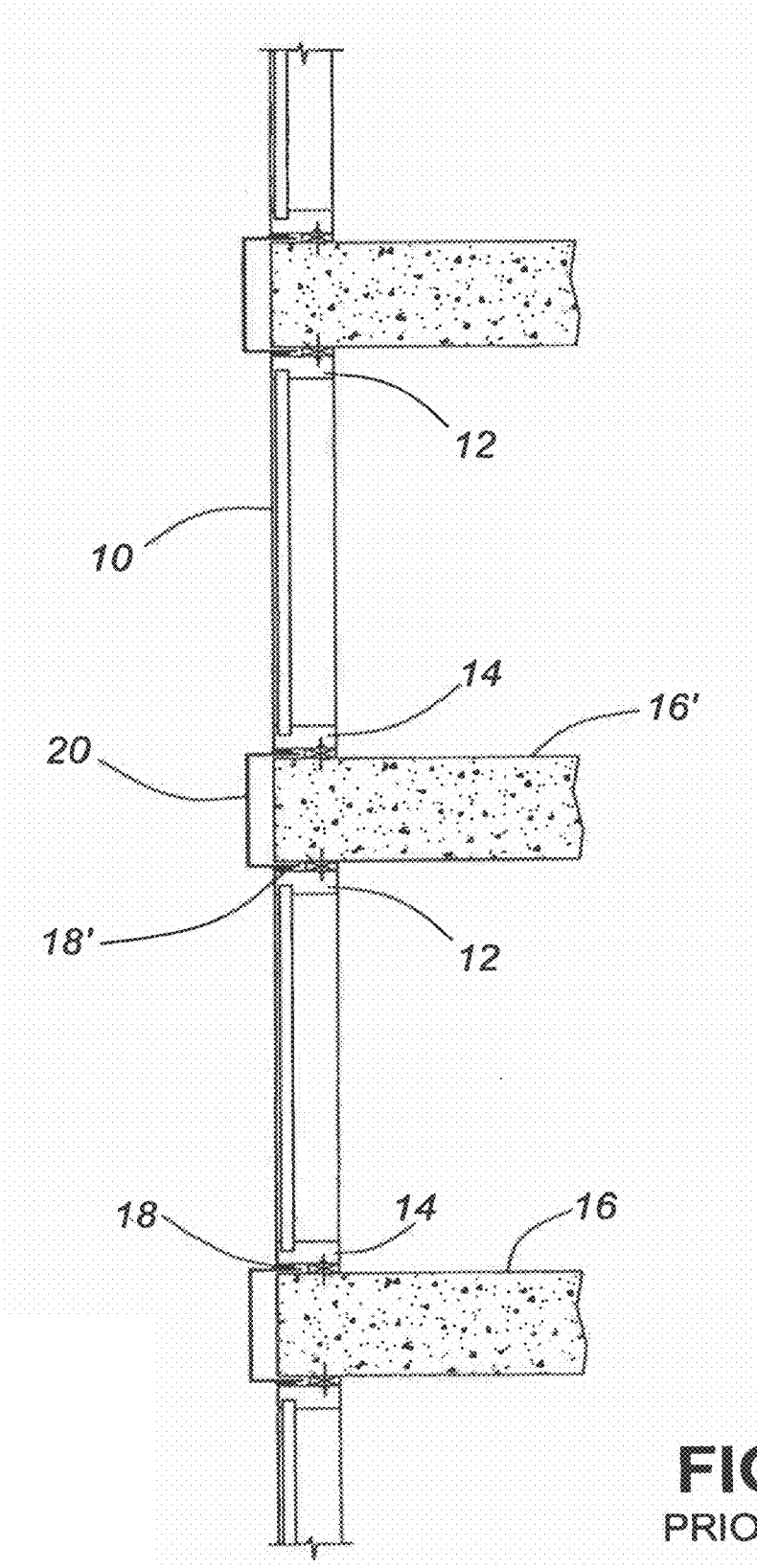
FIG. 1 PRIOR ART
FIG. 1 presents a vertical cross-sectional view of a window wall system as known in the art.
Figure 2:
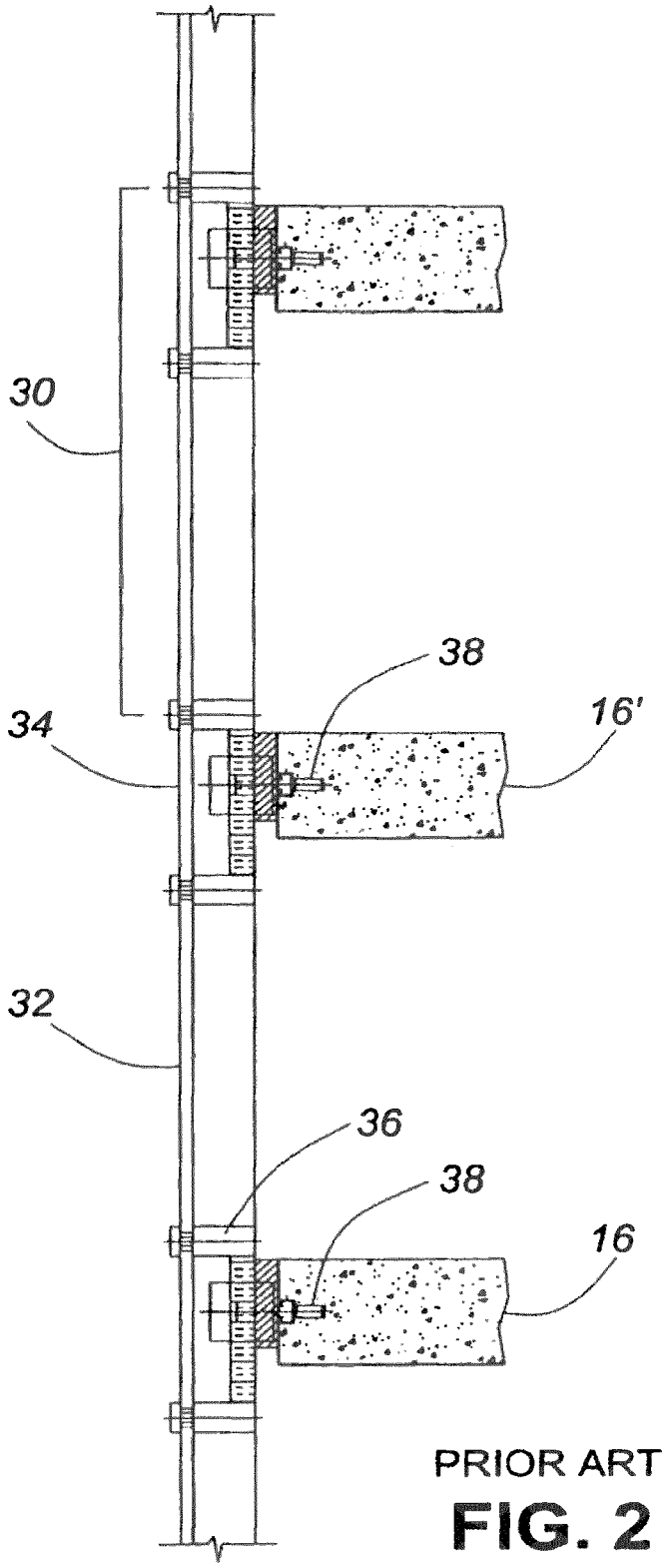
PRIOR ART FIG. 2
FIG. 2 presents a vertical cross-sectional view of a curtain wall system as known in the art.
Figure 3:
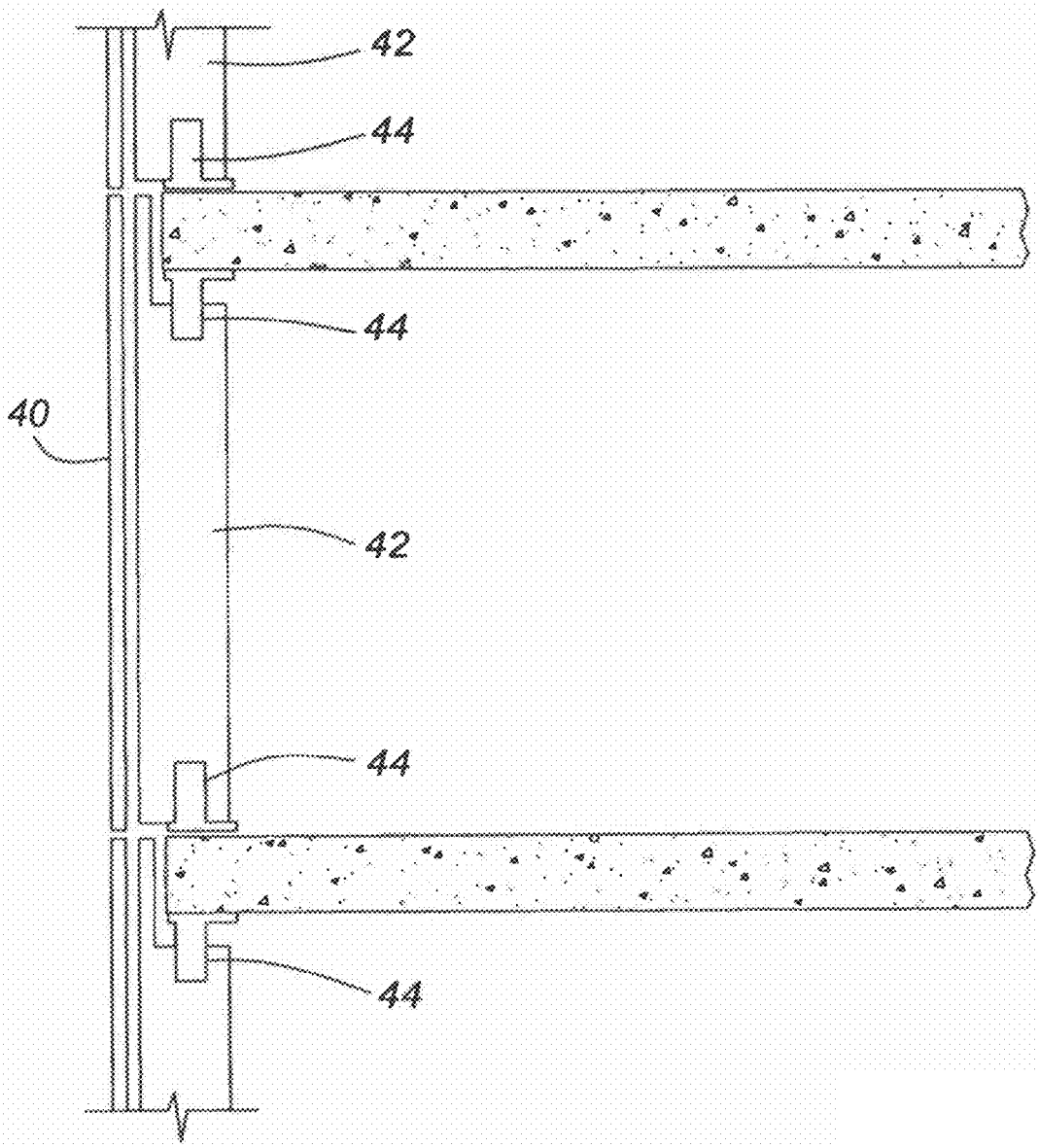
FIG. 3 presents a vertical cross-section of a cladding system in a broad embodiment of the invention.

A broad embodiment of the invention is presented in the vertical cross section diagram of FIG. 3. Specifically, this figure shows that individual framed panels 40 are supported with vertical mullions 42 on their sides. The vertical mullions 42 interconnect horizontally adjacent individual framed panels 40, which is common teaching in the art. Particular to the invention though, is that each of the vertical mullions 42 is notched to accommodate the thickness of the concrete floor slabs. As well, the individual framed panels are attached to the top of a lower floor slab and to the underside of an upper floor slab by means of two anchors 44 which are fastened respectively to the top and underside surface of the lower and upper concrete floor slabs. As noted above, it is desirable that one of these two anchors 44 be fixed to its vertical mullion 42, while the other be able to slide within it. This allows the system to move, and accommodate expansion and contraction of the concrete floor slabs, seismic motion, etc.

The system of the invention does not need the costly embedded anchor plates used in conventional curtain wall systems because it is anchored to the top and bottom of the floor slabs by means of expansion anchors through the integral mullion sleeve anchors. The sound attenuation and fire safing performance of the invention are superior to that of a conventional curtain wall system due to the fact that the vertical mullions are interrupted at each floor slab, thereby preventing a "smoke stack effect" (transfer of sounds and fumes to the next floor) within the interior cavity of the vertical mullions.

The invention provides a system which at least matches the performance and appearance of a unitized curtain wall with the important distinction that it installs between floors like a regular window wall system. This is the only similarity between the system of the invention and any of the window wall systems currently available in the market. The system of the invention is notched around the floor slabs and allows the use of glass floor spandrels in lieu of the slab edge, metal panel covers. Because it is a true unitized curtain wall system, it employs the horizontal expansion assemblies with gaskets, making the typical sealant joints between floor slabs and window wall frames obsolete. The system of the invention also employs fully integrated, fixed and sliding anchors enabling ease of installation while allowing for construction slab tolerances and vertical live load movements between floor levels.

Thus, the invention solves the detrimental issues of the design features of a conventional curtain wall system without diminishing the performance and design flexibility of a conventional unitized curtain wall system. The preferred embodiments of the invention also provide other advantages, as described hereinafter.

DETAILED DESCRIPTION OF PREFERRED EMBODIMENTS OF THE INVENTION

The invention can be applied in many different manners, some embodiments exploiting only a selection of the advantages of the invention rather than all of them. In some cases, for example, it may be decided to compromise on certain advantages to reduce costs.

Figure 4:
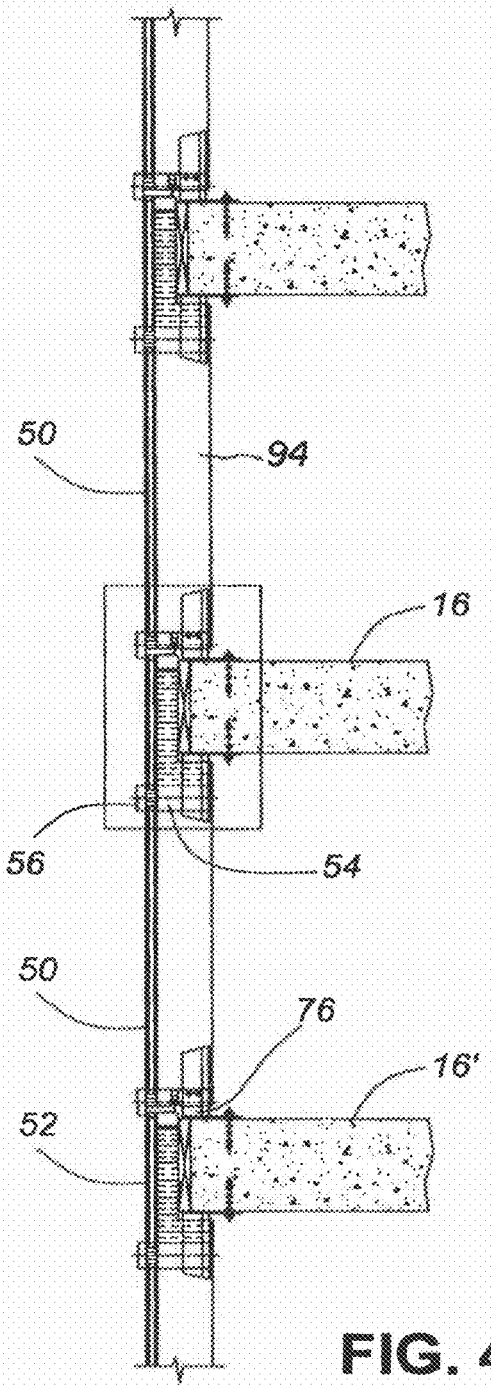
FIG. 4 presents a vertical sectional view of a cladding system in a preferred embodiment of the invention, where the expansion joint is located at the top of the slab.
Figure 5:
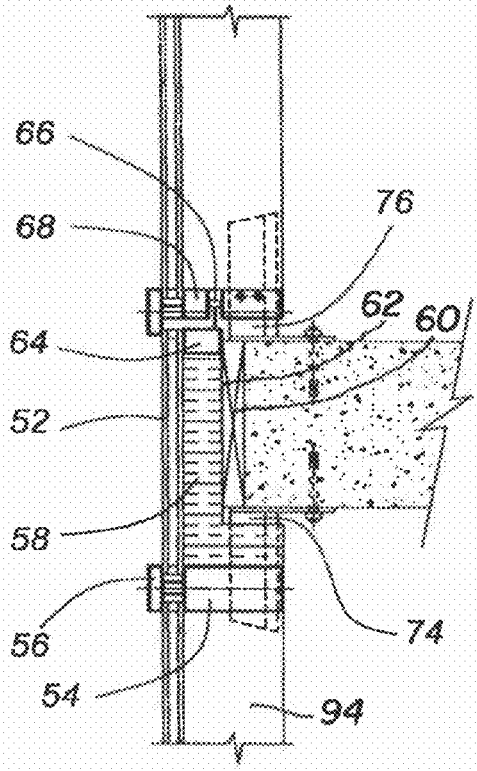
FIG. 5 presents an enlarged detailed sectional view of the cladding system of FIG. 4.
Figure 6:
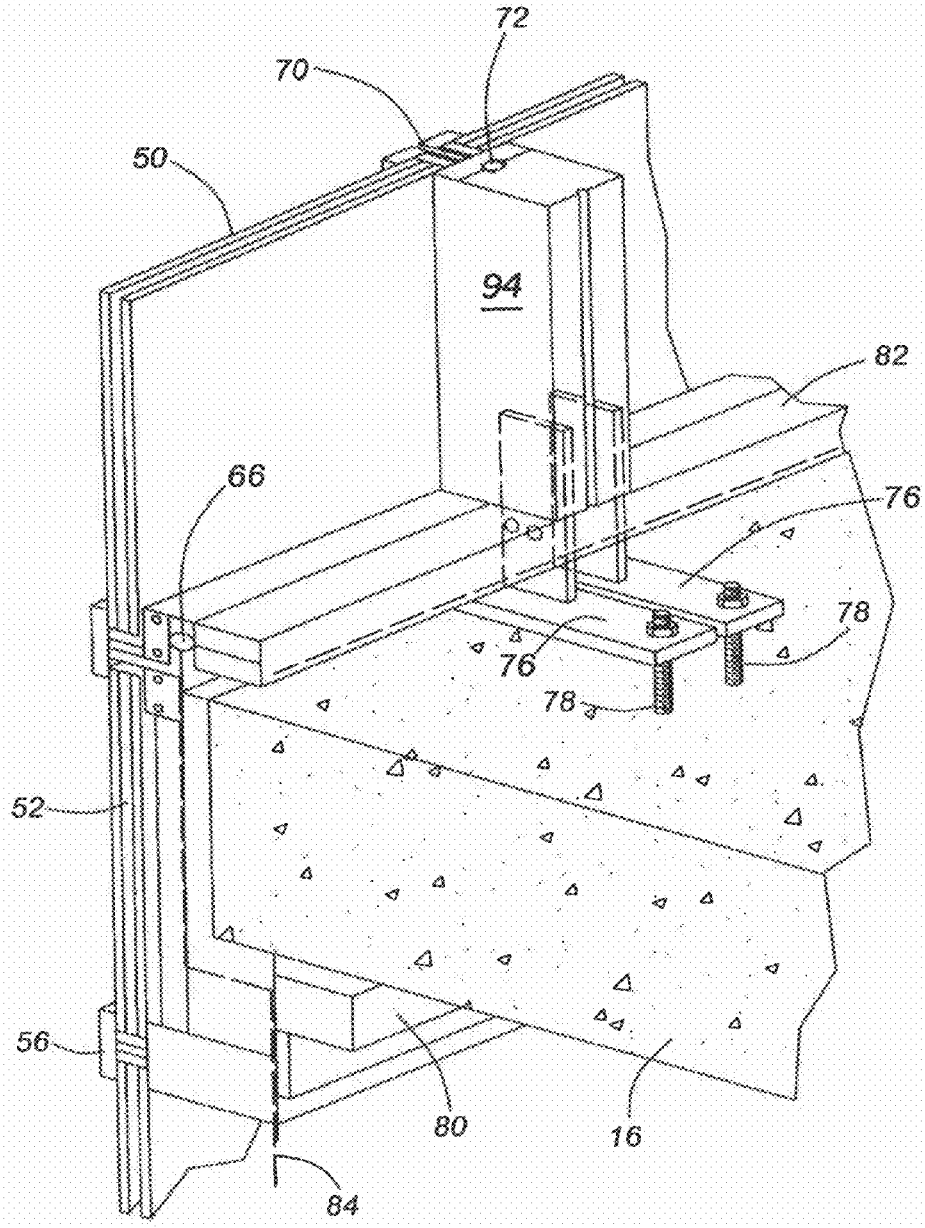
FIG. 6 presents a enlarged detailed orthogonal view of the cladding system of FIG. 4.
Figure 7:
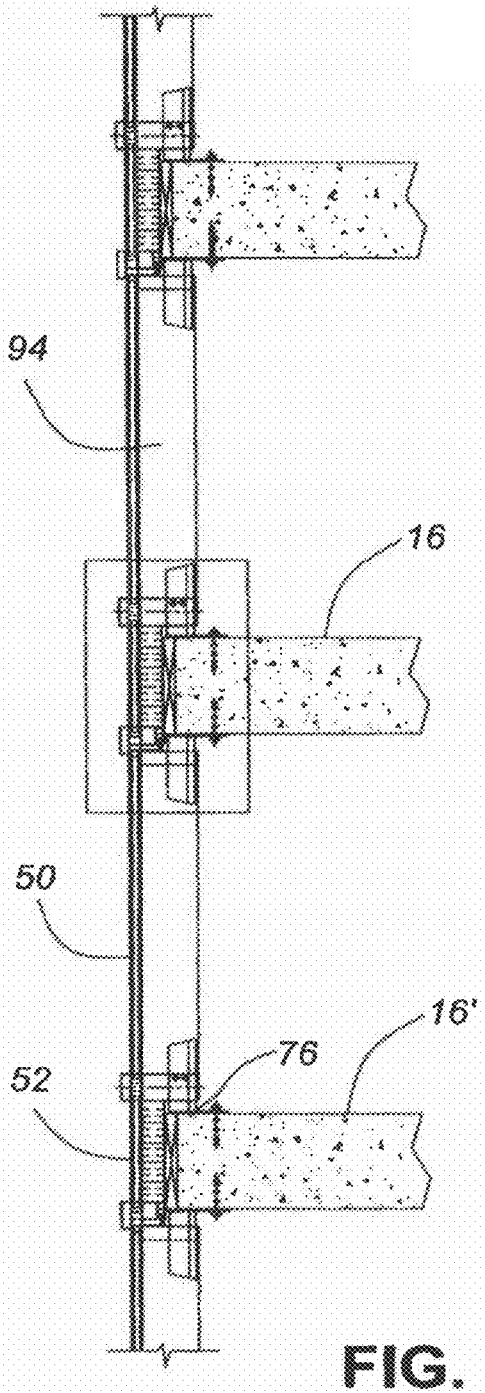
FIG. 7 presents a vertical sectional view of a cladding system in a preferred embodiment of the invention, where the expansion joint is located at the top of the slab.
Figure 8:
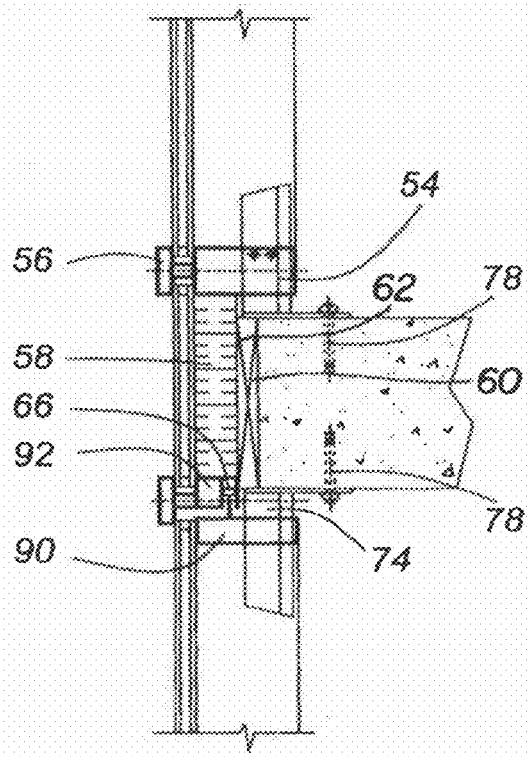
FIG. 8 presents a enlarged detailed sectional view of the cladding system of FIG. 7.
Figure 9:
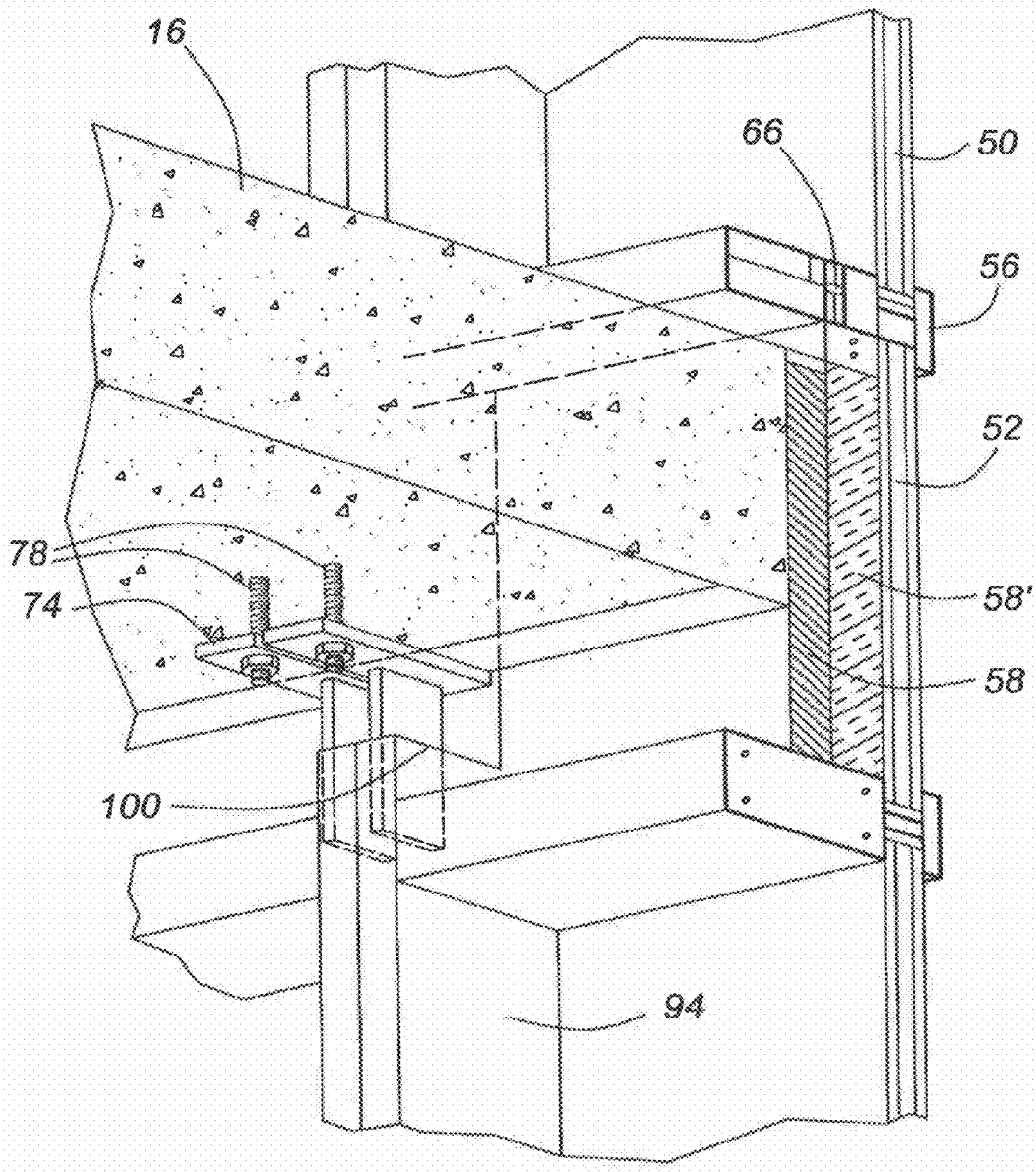
FIG. 9 presents a enlarged detailed orthogonal view of the cladding system of FIG. 7.

There are two main variations of the invention, both of which employ one sliding anchor and one fixed anchor per vertical mullion. FIGS. 4, 5 and 6 present a variation where the sliding anchor is mounted on the underside of the upper floor slab, and the fixed anchor is mounted on the top surface of the lower floor slab. FIGS. 7, 8 and 9 present the opposite arrangement—where the sliding anchor is mounted on the lower slab, and the fixed anchor is mounted on the upper. The arrangement of FIGS. 4, 5 and 6 is preferred because it is easier to fire proof.

FIG. 4 presents a vertical cross section of the arrangement where the sliding anchor is mounted on the underside of the upper concrete floor slab. In this particular arrangement, the rigid panels 40 may be pre-fabricated with a large section of vision glass 50 and a smaller section of spandrel glass 52. The vision glass 50 of course, could also be replaced with an insulated panel, a laminated panel or a monolithic panel of some sort. It could also be finished with any typical architectural material such as granite, limestone, stainless steel, aluminum plate or composite panels. Similarly, the spandrel glass panel 52 could also be filled with an insulated panel, a laminated panel, or a monolithic panel consisting of any architectural material including granite, limestone, stainless steel, aluminum plate or composite material.

It is preferable that the vision glass 50 employ high quality panes of glass. Some systems use inexpensive glass units with a single seal. If the single seal fails, the units are going to break down and start fogging up. A single-sealed glass pane is lower in cost than a double-sealed unit, but provides an inferior product, hence it is preferable to use double-sealed units. With the invention there is no limitation on what kind of vision glass 50 could be installed. Regular vision glass is one inch thick, comprising ¼ inch glass, a ½ inch air space, and ¼ inch glass. However, the invention can also be implemented with triple glass units, which are often 2 inches or 2½ inches thick, or other glass systems.

The vision glass 50 and spandrel glass 52 portions are vertically interconnected with one another via an extruded aluminum transom 54, which is finished with an exterior aluminum or stainless steel cap 56 and pressure plate. Both the transom 54 and cap 56 may be the same as those used in regular curtain wall systems, and are known in the art. Both are available in many standard and custom shapes. An alternate option is to have a capless horizontal joint with structural silicone applied to the glass.

Between the concrete slab 16 and the spandrel glass 52 a layer of insulation 58 is generally required, such as mineral board insulation with an aluminum foil backing or metal back pan (as required for the installation). This insulation runs the full horizontal length of each rigid panel 40, and is typically bonded to the aluminum frame members during the pre-fabrication of the rigid panels 40, with reinforced aluminum tape or in some similar manner.

Additional mineral board insulation 60 and a smoke seal 62 are installed in the field as required to comply with local fire codes. Typically, this work is done by a specialized contractor and not by the installer of the curtain wall or wind wall system.

The top edge of each pre-fabricated rigid panel 40 is finished with an extruded aluminum header 64, which includes a horizontal airseal gasket 66. In combination with a horizontal sill extrusion 68 on an adjacent rigid panel 40 mounted above, which finishes the bottom of each pre-fabricated rigid panel 40, the extruded aluminum header 64 and horizontal airseal gasket 66 make up a horizontal expansion assembly which absorbs vertical interstory movement. With this arrangement, the thermal cycling of expansion and contraction can be accommodated without requiring a large bead of caulking as in window wall systems. An enlarged detail of the arrangement of components 52, 54, 56, 58, 64 and 66 is presented in FIG. 5.

Note that in the system of the invention all of the joints are gasketed; no caulking or other sealants are used for weatherproofing. Gasketed seals slide against each other, and will last far longer than other sealing systems without breaking down. The gaskets are preferably made of high-grade materials such as silicone. Less expensive EPDM (Ethylene Propylene Diene Monomer) or santoprene thermoplastic gaskets will not last as long, though some markets may demand them because of their lower cost.

It is also notable that the sills, headers and mullions of the invention are designed to protect the gaskets from having to face environmental conditions directly. In FIG. 5, for example, it is clear that the horizontal airseal gasket 66 is protected by a labyrinth of aluminum extrusions.

The rigid panels also include, of course, vertical mullions 68. The vertical mullions 68 in FIGS. 4, 5 and 6 are all notched at the top, to accommodate the "top of slab" installation for the sliding anchor 74. The vertical mullions in FIGS. 7, 8 and 9 are all notched at the bottom to accommodate the "bottom of slab" installation for the sliding anchor. The notch must be wide enough to accommodate the sliding anchor, but still thick enough to allow room for insulation to be installed between the spandrel glass 52 and the face of the concrete slab 16, 16'.

In the preferred embodiment of the invention, these vertical mullions 68 are two-piece aluminum mullions with separate female and male portions that snap together. The invention provides a unitized system, so each independent unitized rigid panel 40 will have a male portion of a vertical split mullion on one side and a female portion on the other. These complementary pairings of vertical mullions simply connect together as the building wall is assembled in a sideways direction.

Typically, these vertical mullions 68 snap together without fastening and can slide with respect to one another. One could use mechanical fasteners such as sheet metal screws to hold them rigidly together, but this would generally not be desirable. The slipping connection between the halves of a given vertical mullion 68 allows for thermal movement and building seismic movement.

Rather than using vertical split mullions, some installations use "stick" curtain wall systems. These "stick" systems are essentially systems of vertical and horizontal tubes which are assembled in the field, rather than being pre-fabricated like the system of the invention. Though the invention could be applied to a stick system, there are many disadvantages to such systems, particularly the high installation cost. Pre-fabrication and pre-assembly are desirable for at least two reasons. As noted above, field labour costs are very high in some urban areas—much higher than they are in more industrial areas. As well, pre-fabrication results in a much higher quality product because more of the work is done under controlled factory conditions. Attempting to do the same work in the field results in losses due to weather conditions, dirt, people damaging and losing materials, etc.

In the perspective sectional drawing of FIG. 6, three other details of the vertical mullions 68 are also clear. Firstly, each vertical mullion 68 is finished with an exterior aluminum or stainless steel cap and pressure plate 70. As noted above, such caps are available in many standard and custom shapes and colours. Secondly, each vertical mullion 68 incorporates a vertical air seal gasket 72 which is integrated into the split mullions. This vertical air seal gasket 72 also mates and/or overlaps with the horizontal air seal gasket 66 to create a continuous gasketed air seal system. Thirdly, the extent of the notching in the vertical mullion 68 is shown with the dotted line 84. As noted above, there is a sufficient gap between the vertical mullion 68 and the concrete floor slabs 16, 16' to allow a layer of insulation to be installed.

All of the vertical and horizontal sills, headers, mullions and other similar framing components are shown in the figures in a simplified form in the interest of clarifying the points of invention. It would be known, however, to one skilled in the art to employ the necessary holes and edges for effective drainage, thermal breaks, etc.

Each vertical mullion 68 is fastened to the concrete floor slabs 16, 16' with two concrete anchors 74, 76; one at the top and one at the bottom. In the arrangement of FIGS. 4, 5 and 6, the concrete anchor 74 at the top, can slide within the vertical mullion 68, while the concrete anchor 76 at the bottom, is fastened to the vertical mullion 68 with two fasteners 86 (self-tapping sheet metal screws or the like). These two fasteners 86 transfer the dead load and provide a moment connection between the vertical mullion 68 and the concrete anchor 76.

In the preferred embodiment, the concrete anchors 74, 76 consist of simple extruded aluminum channel uprights which are welded to bases made of aluminum plate. The precise dimensions required will depend on the parameters for a given application but are easily calculated. Depending on the vertical mullion design where the concrete anchors 74, 76 are engaged into a frame it may be tapered or not at the end condition. Two of such variants on the concrete anchors 74, 76 are shown in the figures. FIG. 6 shows a variant of the concrete anchors 74, 76 having a right-angled square at the top, while FIG. 5 shows anchors with a slope or taper. The advantage of a tapered end condition is that it allows the installer at the site or during the assembly to guide the anchor into the vertical mullion more easily between the engagement points of the vertical mullion.

As noted above, aluminum is typically used for all of the system components (mullions, anchors, etc.), and is generally accepted in the art over steel. Aluminum is lighter to handle and fabricate, and does not rust like steel. As well, if one was to manufacture both steel and aluminum systems, one would have to separate all the processes because the same equipment cannot be used to fabricate the two materials.

These concrete anchors 74, 76 are fastened to the horizontal surfaces of the concrete floor slabs 16, 16' using standard expansion anchors 78 (or any other suitable type of fastener) as shown in FIG. 6. This is in contrast to curtain wall systems which require expensive anchors, embedded into the concrete floor slabs 16, 16', generally on the face of the floor slabs. Expansion anchors and other similar fastener systems cannot be used with convention curtain wall systems because they cannot handle the stresses which the system creates. However, comparatively inexpensive expansion anchors can be used with the preferred embodiment of the invention, even in the tallest buildings. With the system of the invention, the expansion anchors only have to take care of lateral loads; there is no rotational action as in the case of curtain wall systems, just "in and out" loads.

The interior of the system is typically finished with two additional pieces of trim. The interior extruded aluminum closure trim 80 is field installed to cover up the mullion anchors at the underside of concrete slab 16, 16' and also provides a mounting surface for tenant applied curtain rail or other sunshade systems. A horizontal snap-on trim cover 82 is also typically provided at the sill extrusion to conceal the fasteners 78. This horizontal snap-on trim cover 82 is installed after the completion of the fixed anchor work.

The remaining details of the system flow logically from the description provided herein, and would be clear to one skilled in the art. For example, at the corners one could install either split mullions or monolithic vertical mullions. Standard 45°, 90°, doglegs and other corners can easily be pre-fabricated. The need for these will depend completely on the building design and shape of or the size of the rigid panels, and it generally changes on every building. The details of these components follow logically from the rest of the design. The difference from existing mullions is that the corners will be notched at the floor slab in the same way as the other vertical mullions.

As noted above, FIGS. 7, 8 and 9 present a very similar arrangement to that of FIGS. 4, 5 and 6 except that the vertical mullions are notched at the bottom rather than the top, and the sliding anchors are mounted on the upper side of the lower concrete slab rather than the underside of the upper concrete slab. Also as noted, the arrangement of FIGS. 4, 5 and 6 is preferred because it is easier to install the necessary fire proofing materials.

FIG. 7 presents a vertical cross section of the arrangement where the sliding anchor is mounted on top of the lower concrete floor slab. In the same way as the system of FIG. 4, the rigid panels 40 are pre-fabricated with a large section of vision glass 50 and a smaller section of spandrel glass 52. The vision glass 50 could be replaced with an insulated panel, a laminated panel or a monolithic panel, and/or finished with any typical architectural material such as granite, limestone, stainless steel, aluminum plate or composite panels. Similarly, the spandrel glass panel 52 could also be filled with an insulated panel, a laminated panel, or a monolithic panel consisting of any architectural material including granite, limestone, stainless steel, aluminum plate or composite material. If vision glass 50 is to be used, it is preferable to employ high quality double-sealed panes of glass. With the invention there is no limitation on what kind of vision glass 50 could be installed; 1 inch, 2 inch or 2½ inch thick systems are all fine.

Just as in FIG. 4, the vision glass 50 and spandrel glass 52 portions are vertically interconnected via an extruded aluminum transom 54, which is finished with an exterior aluminum or stainless steel cap 56 and pressure plate. The only difference in FIG. 7 is that the spandrel glass 52 portion is at the lower end of a given rigid panel 40, rather than at the top end. Both the transom 54 and cap 56 may be the same as those used in regular curtain wall systems, and are known in the art. Both are available in many standard and custom shapes. An alternate option is to have a capless horizontal joint with structural silicone applied to the glass.

Because the spandrel glass 52 is at the lower end of a given rigid panel 40, the layer of insulation 58 will also be at the lower end. In the same way as in FIG. 4, this layer of insulation 58 will generally be a mineral board insulation with an aluminum foil backing or metal back pan (as required for the installation), and runs the full horizontal length of each rigid panel 40, typically being bonded to the aluminum frame members during pre-fabrication of the rigid panels 40, with reinforced aluminum foil tape. Additional mineral board insulation 60 and a smoke seal 62 are installed in the field as required to comply with local fire codes.

Note that the arrangement of the extruded aluminum header 64, horizontal airseal gasket 66 and horizontal sill extrusion 68 are also different in this embodiment. While the horizontal airseal gasket 66 is basically unchanged, the top edge of each pre-fabricated rigid panel 40 is finished with a wider extruded aluminum header 90 to accommodate the width at the top of these panels, as shown in FIG. 7. The bottom of each panel is finished with a narrow horizontal sill extrusion 92 because this portion of the rigid panel 40 includes the notch around the concrete floor slab 16, 16'. Together, the header 90, horizontal airseal gasket 66 and horizontal sill extrusion 92 make up the horizontal expansion assembly which absorbs vertical interstory movement. With this arrangement, the thermal cycling of expansion and contraction can be accommodated without requiring a large bead of caulking as in window wall systems. An enlarged detail of the arrangement of components 52, 54, 56, 58 and 66, 90 and 92 is presented in FIG. 8.

In the same way as the system of FIGS. 4, 5 and 6 it is also preferred that this embodiment be implemented with high quality silicone (or similar) gaskets, and that the extrusions are designed to protect the gaskets.

The rigid panels of FIGS. 7, 8 and 9 also include vertical mullions 94, except that they are notched at the bottom, rather than at the top, to accommodate the "bottom of slab" installation for the sliding anchor 74. The notch must be wide enough to accommodate the sliding anchor, but still thick enough to allow room for insulation to be installed between the spandrel glass 52 and the face of the concrete slab 16, 16'. In the same way as described above, it is preferred that these vertical mullions 94 are two-piece aluminum mullions with complementary pairings of male and female mullions-halves installed on adjacent rigid panels 40, so that they simply connect together as the building wall is assembled in a sideways direction. Again, it is desirable that these vertical mullions 94 be allowed to slide with respect to one another to allow for thermal movement and building seismic movement.

The system of FIGS. 7, 8 and 9 can also be employed with "stick" curtain wall systems, and the same pre-fabrication methodology can be used as with the system of FIGS. 4, 5 and 6.

FIG. 9 presents an orthogonal sectional detail similar to that of FIG. 6. Though there are not shown in this view, the vertical mullions 94 will be finished with an exterior aluminum or stainless steel cap and pressure plate. As well, each vertical mullion 94 incorporates a vertical air seal gasket which is integrated into the split mullions, generating a continuous gasketed air seal system in cooperation with the horizontal air seal gasket 66. The extent of the notching in the vertical mullion 94 is shown with the dotted line 100. As noted above, there is a sufficient gap between the vertical mullion 94 and the concrete floor slabs 16, 16' to allow a layer of insulation to be installed.

As in FIGS. 4, 5 and 6, each vertical mullion 94 is fastened to the concrete floor slabs 16, 16' with two concrete anchors 74, 76; one at the top and one at the bottom. The concrete anchor 74 at the top, can slide within the vertical mullion 94, while the concrete anchor 76 at the bottom, is fastened to the vertical mullion 94 with two fasteners 86 (self-tapping sheet metal screws or the like). These two fasteners 86 transfer the dead load and provide a moment connection between the vertical mullion 68 and the concrete anchor 76.

Just as in FIG. 6, the concrete anchors 74, 76 are fastened to the horizontal surfaces of the concrete floor slabs 16, 16' using standard expansion anchors 78 (or any other suitable type of fastener) as shown in FIG. 9. This is in contrast to curtain wall systems which require expensive anchors, embedded into the concrete floor slabs 16, 16', generally on the face of the floor slabs.

Also, the interior of the system is typically finished with the interior extruded aluminum closure trim 80 to cover up the mullion anchors at the underside of concrete slab 16, 16', and the horizontal snap-on trim cover 82 is also typically provided at the sill extrusion to conceal the fasteners 78.

Just as with the system of FIGS. 4, 5 and 6, the remaining details of the system flow logically from the description provided herein, and would be clear to one skilled in the art. Standard 45°, 90°, doglegs and other corners can easily be pre-fabricated, each of these mullions being notched in the same way as the other vertical mullions.

An embodiment of the invention is to be marketed by Sota Glazing under the Hybrid-Wall® name.

Method of Installation

Figure 10:
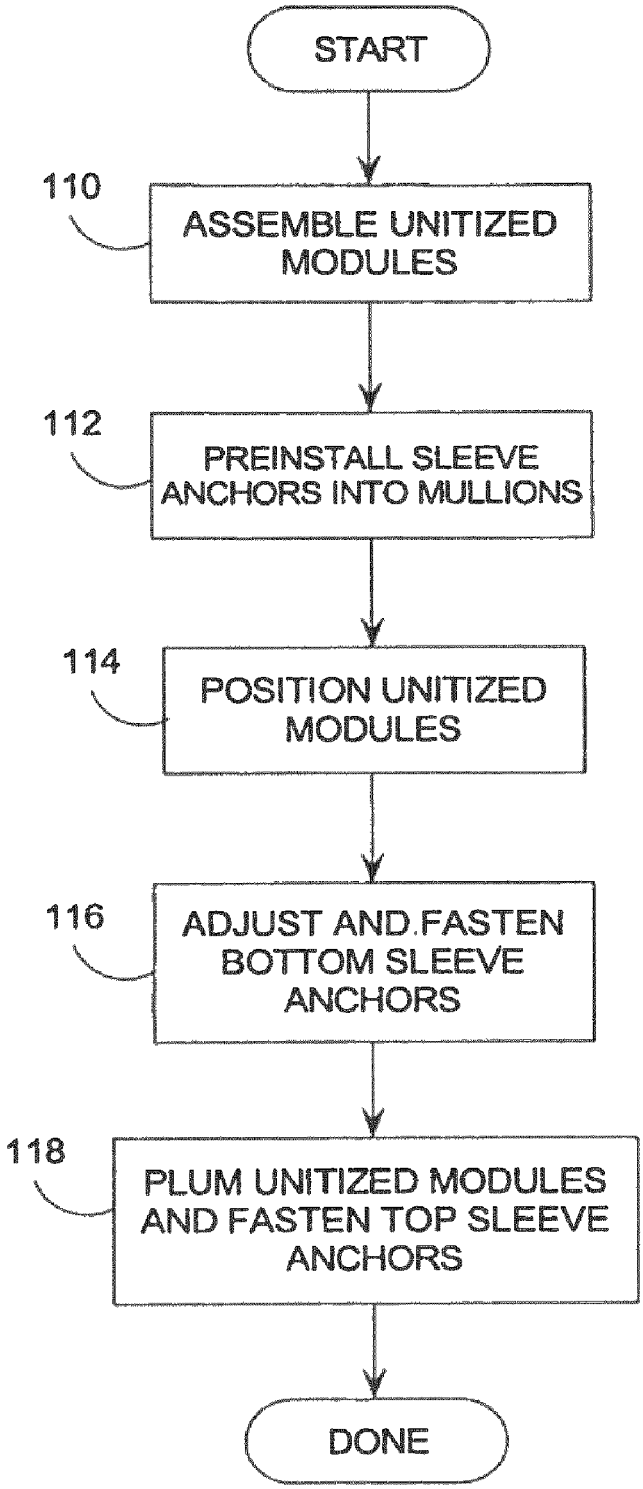
FIG. 10 presents a flow chart of a method of installation for a cladding system in an embodiment of the invention.

The installation of the system of the invention is done in a way that is very similar to curtain wall systems. Firstly, the rigid panels are pre-assembled per step 110 of FIG. 10. Typically, the rigid panels 40 of the invention are shipped with the anchors 74, 76 already slipped into the vertical mullions per step 112, and are held there using tape or a temporary fastener, such as a sheet metal screw. This temporary fastener can be placed in a location that will not be visible once the installation is complete.

Per step 114, the rigid panels 40 are then hung from a little hoist from an upper floor, and are moved into position, adjacent to a rigid panel which has already been installed, and approximately three or four inches about its final installed position. Each rigid panel is interlocked with the adjacent rigid panel, the two halves of the vertical split mullion being snapped together.

The rigid panel 40 is adjusted and fastened per step 116 by lowering it down until it engages with the horizontal air seal gasket 66. Once that is done, the anchors 74, 76 are simply pushed from the vertical mullions until they are flush with the surfaces of the concrete floor slabs 16, 16', the rigid panel 40 is plumbed, and the anchors 74, 76 are fastened to the slabs 16, 16'.

Then, using self-tapping screws or similar fasteners, the screws are fastened through the vertical mullions and the sleeves at the bottom, to create a dead load connection.

The interior extruded aluminum closure trim 80, horizontal snap-on trim cover 82 and any other finishing can now be installed on the interior. Finally, the system can then be fire-safed as required, and the installation is complete.

ADVANTAGES

The system of the invention provides a blend of conventional curtain wall and window wall systems. A curtain wall system is considered a high cost but best performing fenestration building envelope, cladding system for high rise buildings. The window wall system is considered a lower cost and lower performing building envelope cladding system. The primary advantage of the system of the invention is to combine the superior performance and design flexibility of a conventional curtain wall system with the economical advantage of a conventional window wall system.

The main market for the system of the invention is residential condominium projects where developers have bought building envelope systems based purely on price. New energy codes and higher performance requirements due to taller structures have pushed conventional window wall systems to their performance limits. The system of the invention is capable of meeting all higher performance and aesthetic requirements at a minimal price increase to present window wall costs.

As noted in the Background of the Invention, window wall systems often have a "prison look". The rigid panels of the window walls are installed between the slabs, so there are necessarily numerous horizontal bars. Because window wall systems are designed with smaller and weaker structural mullions, designers are forced to use more of them, resulting in more vertical lines. Currently, vertical mullions in window wall systems are spaced on the order of between three- and four-foot centers, while the invention typically uses four- to five-foot centers. Thus, the systems of the invention opens up more vision area and results in less metal lines. The invention can use fewer vertical mullions because it is actually more economical with the design of the invention to do so. Fewer vertical mullions makes for fewer anchors to install, and faster and less-expensive installation.

Also as noted above, window wall systems have a single seat from the outside, like a fish tank, meaning if the exterior field breaks down, water will run into the building. With the system of the invention there is a dual line of defense, because it is a curtain wall system. There is an exterior line of defense via the continuous vision glass/spandrel glass cladding, and a secondary air seal line in the centre of the system. So, if the exterior breaks down, the secondary line will take over and defend the infiltration. The window wall does not have that; it is a single line of defense system.

Additional Options and Alternatives

The present invention has been described with regard to several embodiments. However, it will be apparent to persons skilled in the art that a number of variations and modifications can be made without departing from the scope of the invention as defined in the claims.

All of the finished surfaces are flexible in respect of how they are finished. The exterior glass, for example, are usually determined by cost and the architectural design and may be any colour, tinted or coloured, opaque, laminated glass, double-laminated, blast-proof, or bomb-proof, etc.

The exterior of the wall can also be finished with large or small caps, sunshades, etc. Most of these finishes are architectural and have nothing to do with the system of the invention per se.

Basically everything is part of the unitized module except the anchors themselves, the insulation and fireproofing and whatever trim pieces might be required.

CONCLUSIONS

There are no special requirements to implement the system of the invention. Most existing curtain wall systems could be modified in the manner of the invention to gain the same advantages. It is straightforward to modify most existing curtain wall systems to exploit the inventions advantages of lower price, ease of installing firesafing between floors, and improvements to sound attenuation between floors.

While the invention has been described in connection with a specific embodiment thereof and in a specific use, various modifications thereof will occur to those skilled in the art without departing from the spirit and scope of the invention as set forth in the appended claims.

What is claimed is:

1. A unitized exterior building envelope cladding system comprising:

individual framed panels, supported with vertical mullions on their sides, said vertical mullions interconnecting adjacent ones of said individual framed panels;

each of said vertical mullions being notched to accommodate the thickness of a concrete floor slab;

each of said individual framed panels being attached to the top of a lower concrete floor slab and the underside of an upper concrete floor slab with anchors fastened respectively to said top and underside surface of said concrete floor slabs; and one of said anchors being fixed to said vertical mullion, and the other of said anchors slidably engaging with said vertical mullion.

2. The unitized exterior cladding system of claim 1, wherein each of said vertical mullions is approximately equal in length to the distance between the top of said lower concrete floor slab and the top of said upper concrete floor slab to which said framed panels are to be installed.

3. The unitized exterior cladding system of claim 2, wherein the height of said notch in each of said vertical mullions is approximately equal to the thickness of said lower concrete floor slab and said upper concrete floor slab.

4. The unitized exterior cladding system of claim 3, wherein said individual framed panels are of sufficient height to seal against vertically adjacent individual framed panels to cover the exterior of a building.

5. The unitized exterior cladding system of claim 3, further comprising an integrated extruded aluminum sleeve anchor assembly.

6. The unitized exterior cladding system of claim 5, wherein each of said anchors comprises a flat plate portion, and a vertical extrusion portion.

7. The unitized exterior cladding system of claim 6, wherein the depth of said notch in each of said vertical mullions is large enough to insert said vertical extrusion portion of said anchor into said vertical mullion in an installed arrangement.

8. The unitized exterior cladding system of claim 6, wherein said anchors are fastened to said concrete floor slabs by way of expansion anchors.

9. The unitized exterior cladding system of claim 4, wherein said panels comprise a material selected from the group consisting: of vision glass, spandrel glass insulated panels, laminated panels, and monolithic panels.

10. The unitized exterior cladding system of claim 4, wherein said panels comprise alternate spandrel infill materials selected from the group consisting of: granite, limestone, stainless steel panels, aluminum plate and composite panels.

11. The unitized exterior cladding system of claim 4, wherein said panels further comprise a layer of mineral board insulation to insulate said upper and lower concrete floor slabs.

12. The unitized exterior cladding system of claim 11, wherein said layer of mineral board insulation further comprises an aluminum foil backing or metal back pan.

13. The unitized exterior cladding system of claim 3, further comprising a capless horizontal joint being vertically adjacent rigid panels, sealed with structural silicone.

14. The unitized exterior cladding system of claim 3, further comprising a horizontal airseal gasket as part of the horizontal expansion assembly, thereby absorbing vertical interstory movement.

15. The unitized exterior cladding system of claim 3, further comprising exterior aluminum, stainless steel caps and pressure plates.

16. The unitized exterior cladding system of claim 6, wherein said vertical mullions comprise vertical split mullions.

17. The unitized exterior cladding system of claim 16, wherein said vertical split mullions comprise male and female split mullion halves, installed on adjacent panels in a complementary manner.

18. The unitized exterior cladding system of claim 17, further comprising a vertical air seal gasket integrated into said split mullions and mating/overlapping with a horizontal air seal gasket to create a continuous gasketed air seal system.

19. The unitized exterior cladding system of claim 9, further comprising an extruded aluminum transom at the head of said vision glass.

20. The unitized exterior cladding system of claim 3, further comprising interior extruded aluminum closure trim, field installed to cover up mullion anchors at underside of slab and mounting surface for tenant applied curtain rail or other sunshade system.

21. The unitized exterior cladding system of claim 3, further comprising two fasteners connecting vertical split mullion to integral sleeve anchor for dead load transfer and moment connection between said mullion and said anchor.

22. The unitized exterior cladding system of claim 3, further comprising a horizontal snap-on trim cover at said sill extrusion, to be installed after installation of fixed anchor to conceal said fasteners.

23. The unitized cladding system of claim 3, wherein said mullions and anchors are fabricated from aluminum.

* * * * *